US008936489B2

(12) United States Patent
Liao et al.

(10) Patent No.: US 8,936,489 B2
(45) Date of Patent: Jan. 20, 2015

(54) Y-SHAPED UNIVERSAL SERIAL BUS CONNECTOR FOR USB 2.0 MICRO-B AND USB 3.0 MICRO-B CONNECTOR SPECIFICATIONS

(76) Inventors: Wen-Yung Liao, New Taipei (TW); Wen-Fu Liao, New Taipei (TW); Sheng-Hsin Liao, New Taipei (TW)

( * ) Notice: Subject to any disclaimer, the term of this patent is extended or adjusted under 35 U.S.C. 154(b) by 52 days.

(21) Appl. No.: 13/612,806

(22) Filed: Sep. 12, 2012

(65) Prior Publication Data

US 2013/0084725 A1 Apr. 4, 2013

(30) Foreign Application Priority Data

Sep. 30, 2011 (TW) ..... 100218415 U

(51) Int. Cl.

| | |
|---|---|
| ***H01R 25/00*** | (2006.01) |
| ***H01R 27/02*** | (2006.01) |
| ***H01R 31/06*** | (2006.01) |
| *H01R 13/60* | (2006.01) |
| *H01R 13/72* | (2006.01) |
| *H01R 24/62* | (2011.01) |

(52) U.S. Cl.

CPC ..... *H01R 27/02* (2013.01); *H01R 31/06* (2013.01); *H01R 13/60* (2013.01); *H01R 13/72* (2013.01); *H01R 24/62* (2013.01)

USPC ..... 439/638

(58) Field of Classification Search

USPC ..... 439/579, 701, 717, 352–358

See application file for complete search history.

(56) References Cited

U.S. PATENT DOCUMENTS

| | | | | |
|---|---|---|---|---|
| 6,881,100 | B2 * | 4/2005 | Barry et al. | 439/701 |
| 6,905,367 | B2 * | 6/2005 | Crane et al. | 439/607.01 |
| 7,086,898 | B2 * | 8/2006 | Johnsen et al. | 439/579 |
| 7,244,145 | B2 * | 7/2007 | Johnsen et al. | 439/579 |
| 7,625,250 | B2 * | 12/2009 | Blackwell | 439/717 |
| 7,837,514 | B2 * | 11/2010 | Fogg | 439/701 |
| 2012/0079140 | A1 * | 3/2012 | Bar-Niv et al. | 710/16 |
| 2013/0217274 | A1 * | 8/2013 | Bar-Niv et al. | 439/676 |

* cited by examiner

*Primary Examiner* — Chandrika Prasad

(74) *Attorney, Agent, or Firm* — Li & Cai Intellectual Property (USA) Office

(57) ABSTRACT

A USB device using a rotatable USB connector includes a cable, a first USB plug, a second USB plug and a rotatable USB connector. The cable has a tail end, a first branch end and a second branch end. The first USB plug connects the tail end, the second USB plug connects the second branch end and the rotatable USB connector connects the first branch end. The rotatable USB connector has a first insulating main body, a second insulating main body, a plurality of first conductive terminals and a plurality of second conductive terminals. The first insulating main body and blades form a first connector module while the second insulating main body and blades form a second connector module. The USB 2.0 and second connector modules are movably connected via a joint.

3 Claims, 14 Drawing Sheets

Y-SHAPED UNIVERSAL SERIAL BUS CONNECTOR FOR USB 2.0 MICRO-B AND USB 3.0 MICRO-B CONNECTOR SPECIFICATIONS

BACKGROUND

1. Field of the Invention

The instant disclosure relates to a rotatable universal serial bus (USB) connector; in particular, to a rotatable USB connector compatible with USB 3.0 standards.

2. Description of Related Art

The standard USB Micro-B connector is widely implemented on hand held devices because of thinner structural profile. USB 3.0 connectors are backward compatible with USB 2.0 in most connector types. However, a USB 3.0 Micro-B connector comprises a USB 2.0 Micro-B connector and an additional set of pins aligned thereto.

The conventional USB 3.0 Micro-B connector is a one-piece structure. In other words, the USB 2.0 Micro-B connector and the additional pin set are permanently interconnected so the USB 2.0 Micro-B connector cannot be singled out and used independently if needed.

SUMMARY OF THE INVENTION

The object of the instant disclosure is to provide a rotatable Universal Serial Bus (USB) connector with separate and mobile plugs.

According to one exemplary embodiment of the instant disclosure, the rotatable USB connector comprises a first insulating main body, a second insulating main body, a plurality of first conductive terminals and a plurality of second conductive terminals. The first conductive terminals are disposed in the first insulating main body forming a first connector module. Likewise, the second conductive terminals are disposed in the US 3.0 insulation main body forming a second connector module. The USB 2.0 and 3.0 modules are interconnected via a mobile joint.

Another embodiment of the instant disclosure provides a USB device comprises a cable with a tail end, a first branch end and a second branch end, a first USB plug and a second USB plug. The first USB plug connects the tail end while the second USB plug connects the second branch end. The USB device further comprises the aforementioned rotatable USB connector connected to the first branch end of the cable.

In summary, the instant disclosure provides the rotatable USB connector with the structurally independent USB 2.0 and second connector modules. The mobile USB 2.0 and second connector modules allow users to have desired USB connector combination for different usages. The first and second USB plugs and rotatable USB connector may further be retained in a case for easier organization and transportation.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE PREFERRED EMBODIMENTS

Figure 1:
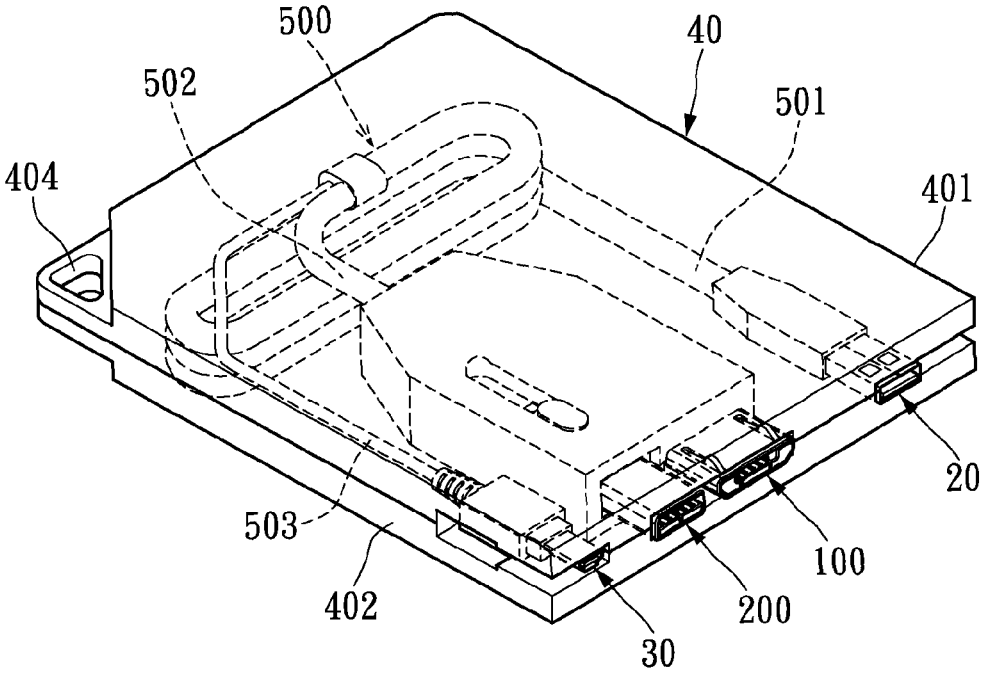
FIG. 1 is a schematic diagram of a USB device using a rotatable USB connector in accordance with a first embodiment of the instant disclosure.

The aforementioned illustrations and following detailed descriptions are exemplary for the purpose of further explaining the scope of the instant disclosure. Other objectives and advantages related to the instant disclosure will be illustrated in the subsequent descriptions and appended drawings.

[First Embodiment]

The instant disclosure provides a rotatable USB connector and a USB device using the same. The rotatable USB connector is compatible with the USB 3.0 Micro-family and B standards. Please refer to FIG. 1~FIG. 7. The rotatable USB connector comprises a first insulating main body 1 (in this case, a USB 2.0 insulation main body), a second insulating main body 2 (e.g. a USB 3.0 insulation main body), a plurality of first conductive terminals 3 (e.g. USB 2.0 type conductive terminals), and a plurality of second conductive terminals 4 (e.g. USB 3.0 style conductive terminals). The first insulating main body 1 includes a first housing 11 and a first tongue 12. The first tongue 12 is attached to the first housing 11 (e.g. USB 2.0 housing) and stretching outward. The first conductive terminals 3 are disposed on the first tongue 12 at predetermined pitch according to the USB IF standard. Each of the first conductive terminals 3 has a first (USB 2.0) raised portion 31, a first (USB 2.0) contact portion 32 and a first (USB 2.0) mounting terminal 33. The first (USB 2.0) raised and contact portions 31, 32 are exposed on the first tongue 12 while the first (USB 2.0) mounting terminal 33 transverses the first housing 11 to the rear end thereof to conduct USB 2.0 communication protocol.

The second insulating main body 2 includes a second housing 21 and a second tongue 22. The second tongue 22 is attached to the second housing 21 and stretching outward. The second conductive terminals 4 are disposed on the second tongue 22 at predetermined pitch according to the USB IF standard. The second conductive terminals consist of a pair of USB 3.0 transmission lines, a pair of USB 3.0 receiving lines and a ground there-between so to allow SuperSpeed signal rate (5 Gb/s). Each of the second conductive terminals 4 has a USB 3.0 raised portion 41, a USB 3.0 contact portion 42 and a USB 3.0 mounting terminal 43. The USB 3.0 raised and contact portions 41, 42 are exposed on the second tongue 22 while the USB 3.0 mounting terminal 43 transverses the second housing 21 to the rear end thereof to conduct USB 3.0 communication protocol. The first (USB 2.0) and USB 3.0 mounting terminals 33, 43 are preferably electronically welded to cables and the connected instruments are not limited thereto.

Figure 5:
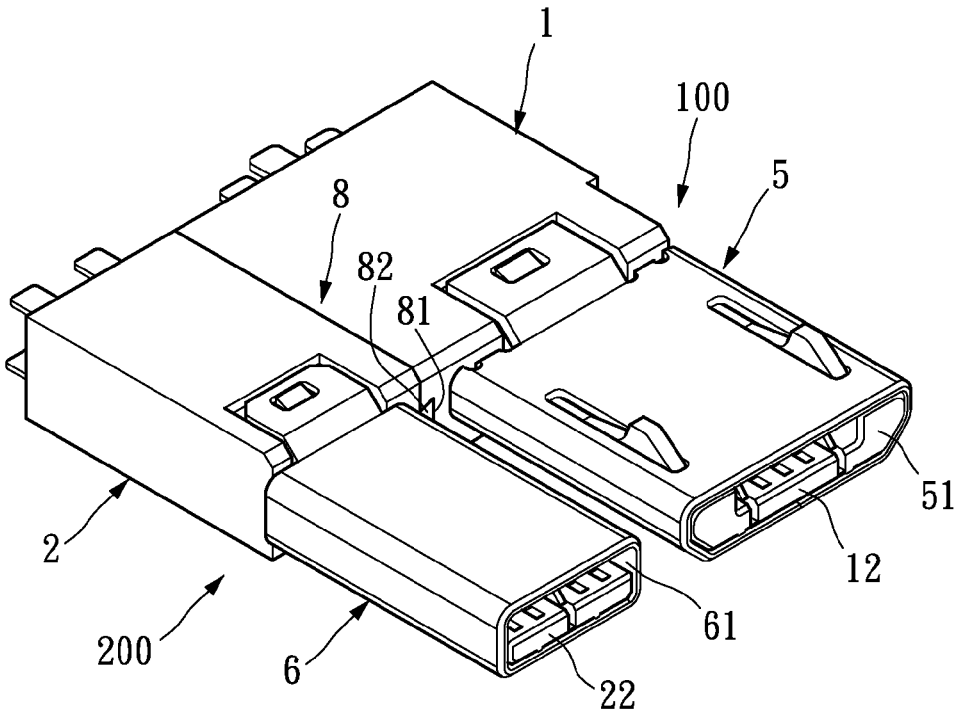
FIG. 5 is a schematic diagram of a rotatable USB connector with shells in accordance with a first embodiment of the instant disclosure.
Figure 6:
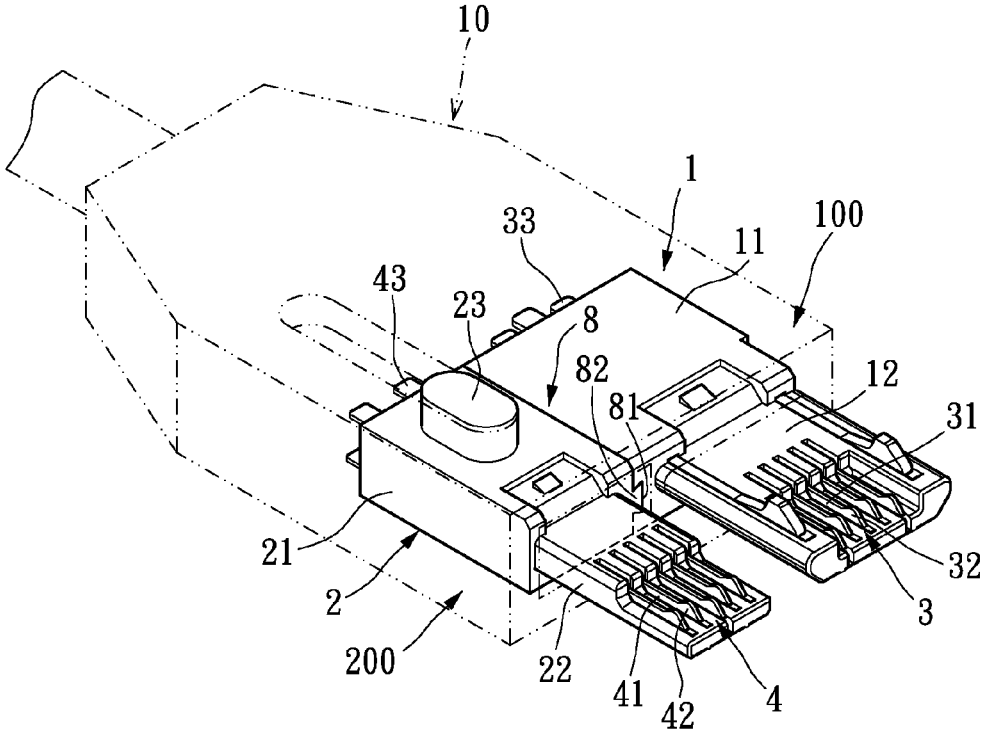
FIG. 6 is a schematic diagram of a rotatable USB connector with a slide button in accordance with a first embodiment of the instant disclosure.
Figure 7:
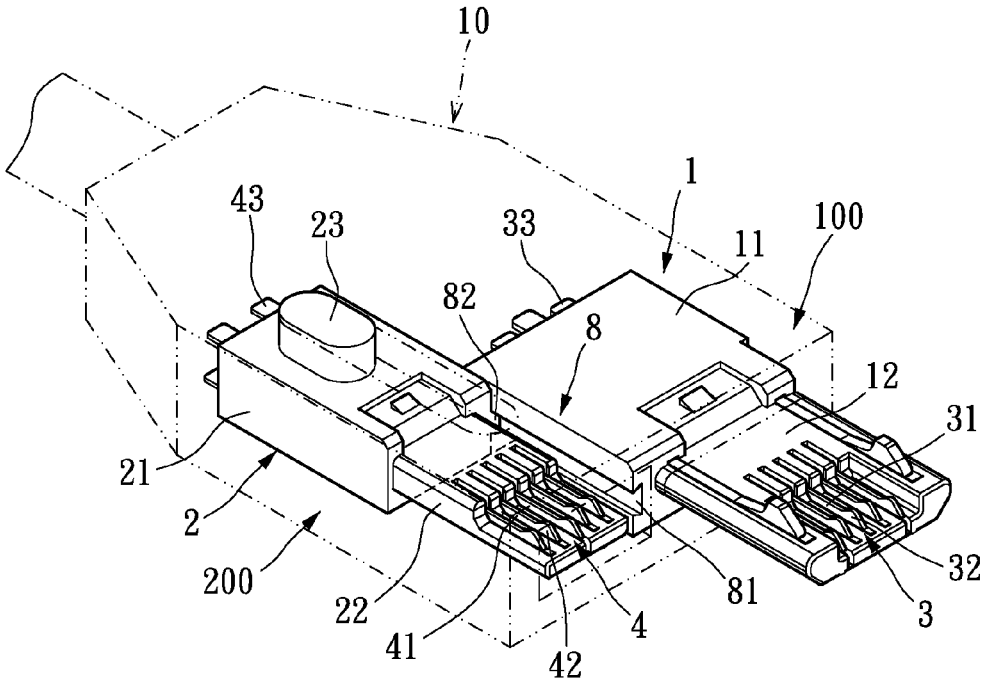
FIG. 7 is a schematic diagram of a rotatable USB connector with a slide button in a retracted position in accordance with a first embodiment of the instant disclosure.

The rotatable USB connector further comprises a first (USB 2.0) shell 5 and a USB 3.0 shell 6 (as shown in FIG. 5). The first (USB 2.0) shell 5 encloses the first tongue 12 and the first conductive terminals 3 inside a first (USB 2.0) slot 51 thereof. The USB 3.0 shell 6 encloses the second tongue 22 and the second conductive terminals 4 inside a USB 3.0 slot 61 thereof.

The first insulating main body 1 and blades 3 make up a first connector module 100. Likewise, the second insulating main body 2 and blades 4 make up a second connector module 200. The first and second connector modules 100, 200 are aligned side by side yet can move independently. In other words, the rotatable USB connector can be used as a USB 2.0 connector alone or a USB 3.0 Micro-B connector when the first and second connector modules 100, 200 are combined. The first and second connector modules 100, 200 are interconnected by a joint 700 and the connection methods and movements thereof are not limited thereto. The first and second connector modules 100, 200 may be connected by pivot pins, tenon or through sliding grooves to move sideway, rotate or slide. One of the first and second connector modules 100, 200 can be mobile or both thereof are mobile.

In the first embodiment, the first and second connector modules 100, 200 are connected by a sliding unit 8 and the joint methods are not limited thereto. The first insulating main body 1 includes a groove 81 over the side which contacts the second insulating main body 2. The second insulating main body 2 includes a slider 82 conforming to the groove 81 so the second connector modules 200 is able to slide forward or backward along the groove 81.

In the first embodiment, the rear ends of the first and second connector modules 100, 200 are further enveloped by a jacket 10. The second connector module 200 can retract backward and allow the single use of the first connector module 100. On the other hand, the first and second connector modules 100, 200 can align side by side and acts as a USB 3.0 Micro-B connector. The second connector module 200 may further include a slide button 23 to allow easier operation.

In the first embodiment, the first connector module 100 is fixed on the jacket 10 while the second connector module 200 is mobile. However, the arrangement is interchangeable and the first and second connector modules being both mobile is also acceptable as long as the movement can be separate.

Figure 2:
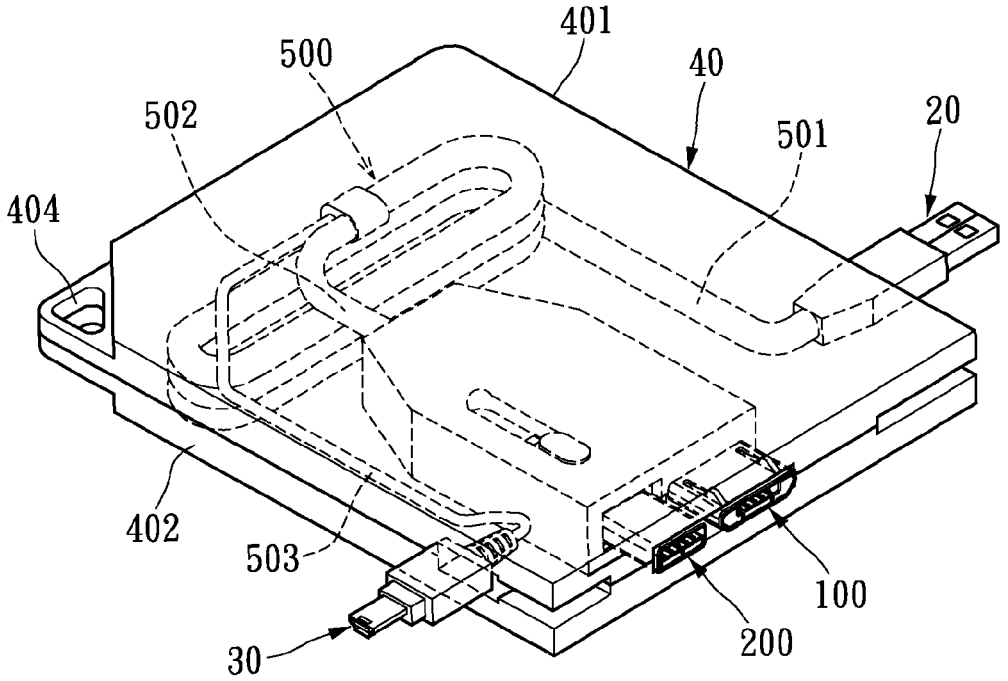
FIG. 2 is a schematic diagram of a USB device using a rotatable USB connector in use in accordance with a first embodiment of the instant disclosure.
Figure 3:
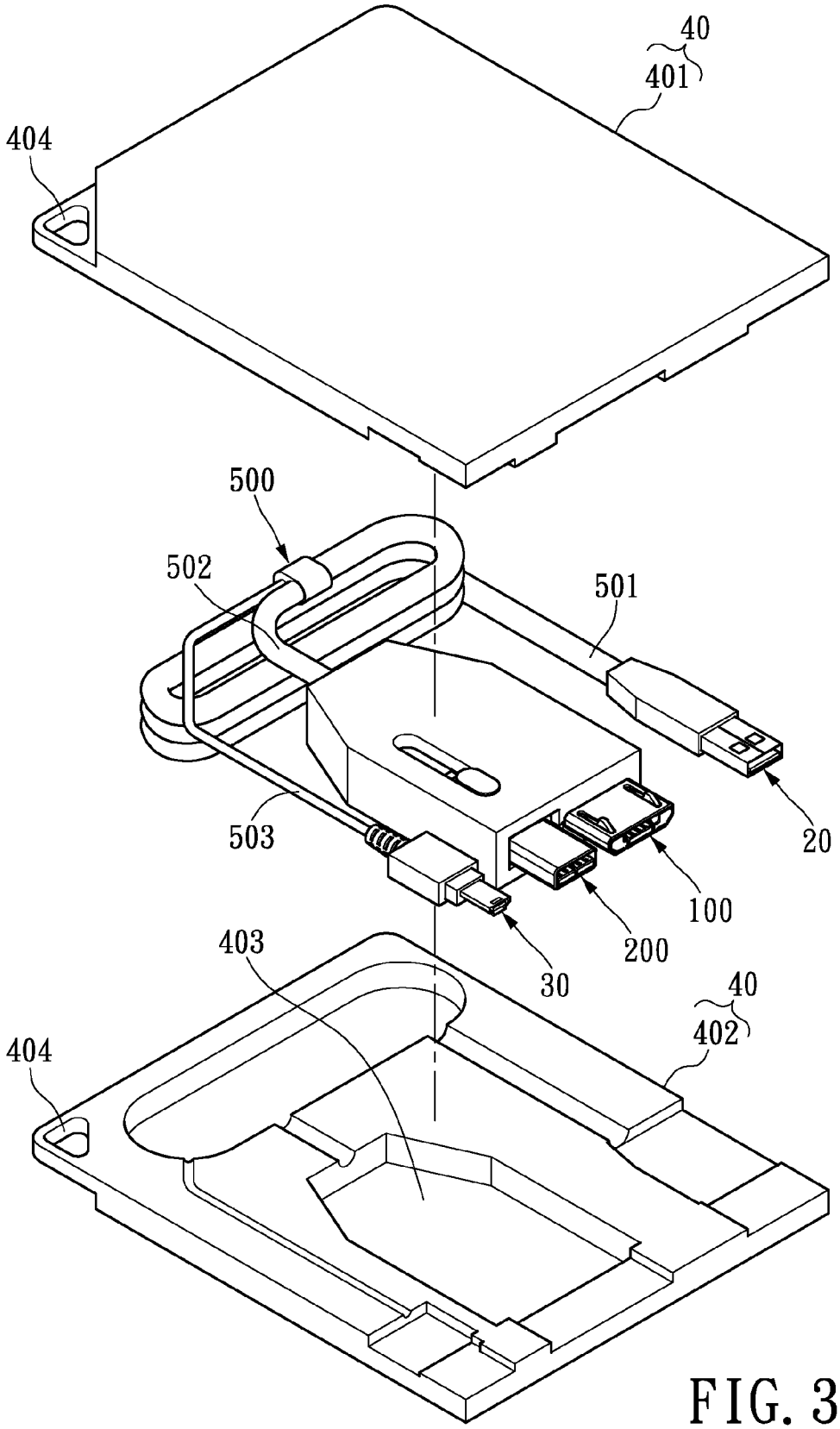
FIG. 3 is an exploded view of a USB device using a rotatable USB connector in accordance with a first embodiment of the instant disclosure.
Figure 4:
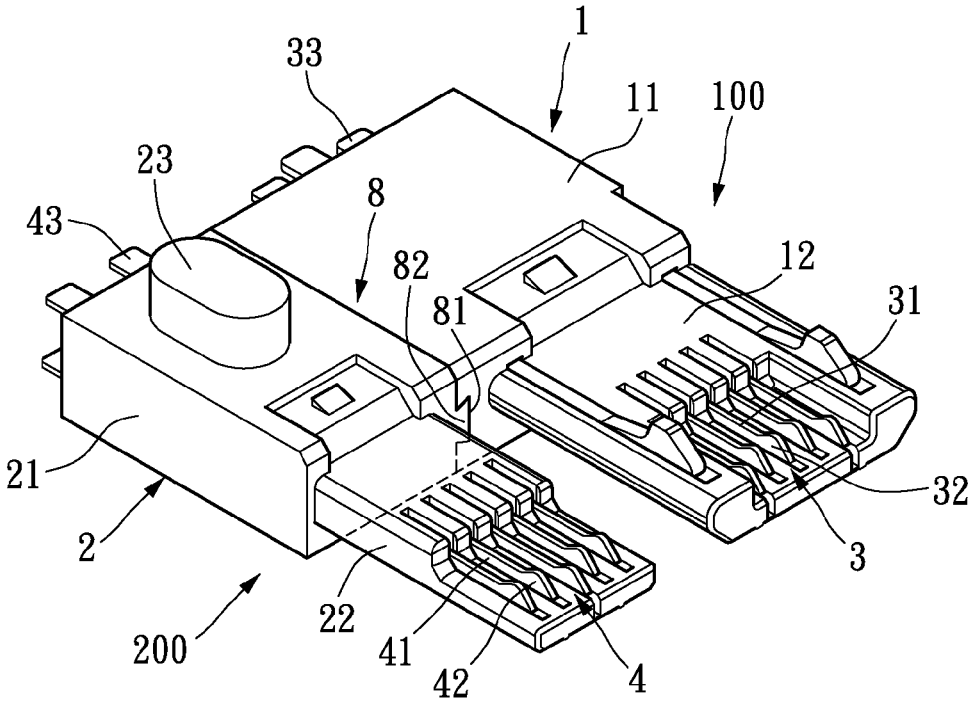
FIG. 4 is a schematic diagram of a rotatable USB connector in accordance with a first embodiment of the instant disclosure.

As shown in FIG. 1 to FIG. 3. The rotatable USB connector may electronically connect a Y-shaped cable 500. The cable 500 includes a tail end 501, a first branch end 502 and a second branch end 503. The tail end 501 connects a first USB plug 20, the first branch end 502 connects the rotatable USB connector and the second branch end 503 connects a second USB plug 30. The first and second USB connector 20, 30 can be any type of connectors which allow standard USB communication protocol.

As shown in FIG. 3 the first and second USB plugs 20, 30, the rotatable USB connector and the cable 500 may be detachably retained in a case 40 to allow free movements. On the other hand, the cable 500 can be fixed on the case 40 while the first and second USB plugs 20, 30 and the rotatable USB connector are mobile. The case 40 includes a ring 404 to hang the case 40 like a key ring. The case 40 can be a one-piece structure or split into a top case 401 and a bottom case 402 and the structure of the case 40 is not limited thereto. The top and bottom cases 401, 402 can be engaged by tenon or screws.

[Second Embodiment]

Figure 8:
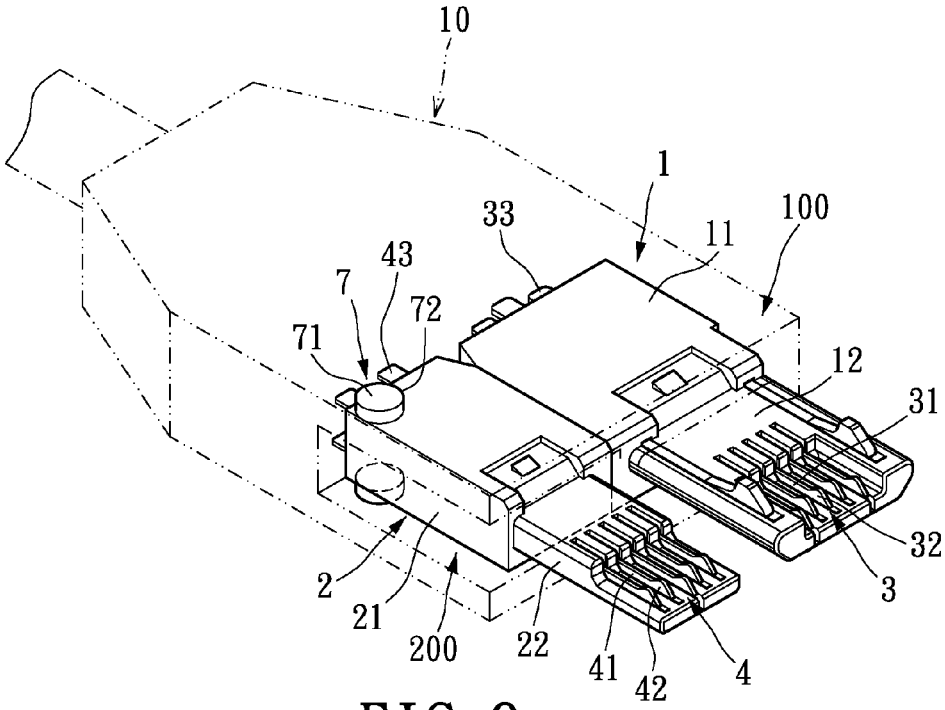
FIG. 8 is a schematic diagram of a rotatable USB connector with a shaft assembly in accordance with a second embodiment of the instant disclosure.
Figure 9:
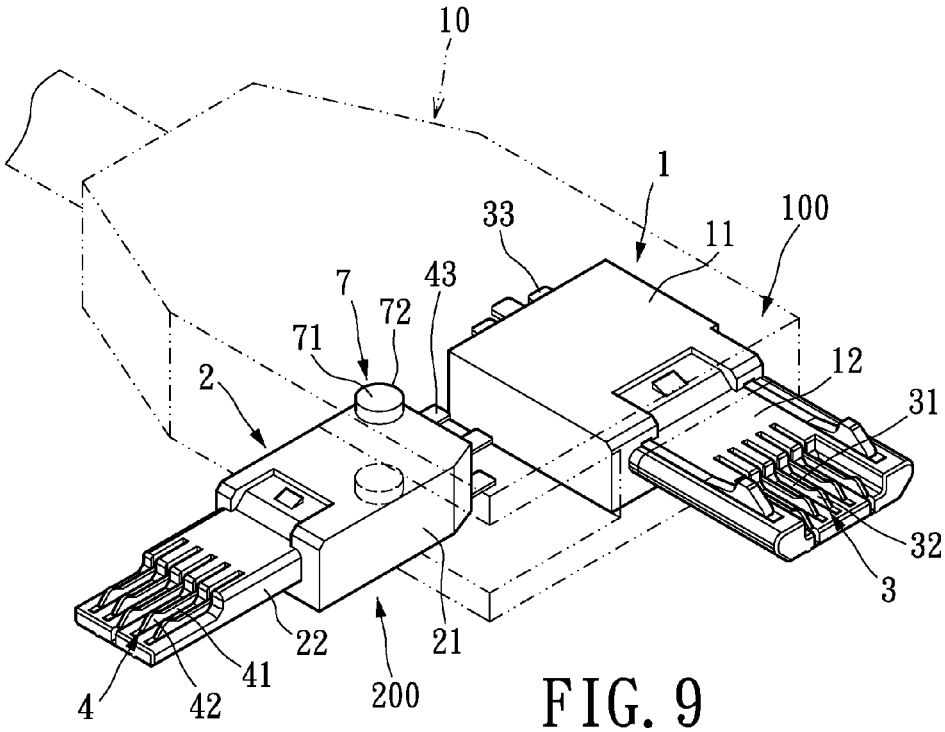
FIG. 9 is a schematic diagram of a rotatable USB connector with a shaft assembly swiveling aside in accordance with a second embodiment of the instant disclosure.

Please refer to FIG. 8 in conjunction with FIG. 9. In the second embodiment, the second connector module 200 is pivotally connected to the jacket 10 to allow level swiveling. A shaft assembly 7 is disposed between the jacket 10 and the read end of the second connector module 200. The shaft assembly 7 includes a cylinder shaft 71 and a conforming shaft sleeve 72 and the structure of the shaft assembly 7 is not limited thereto. The shaft 71 substantially perpendicularly transverses the second insulating main body 2 touching the jacket 10 by two ends and is movably disposed in the shaft sleeve 72. The arrangement of the shaft 71 and the shaft sleeve 72 is interchangeable between the second connector module 200 and the jacket 10.

In the second embodiment, only the second connector module 200 is able to swivel levelly so the first connector module 100 can be singled out on the jacket 10 and connect a corresponding receptacle independently. The first and second connector modules can also be combined together to act as a USB 3.0 connector.

The first and second connector modules 100, 200 can be connected by tenon (not shown in the figure). Dowels can be disposed between the first and second insulation main bodies 1, 2 or among the first, second insulation main bodies 1, 2 and the jacket 10.

[Third Embodiment]

Figure 10:
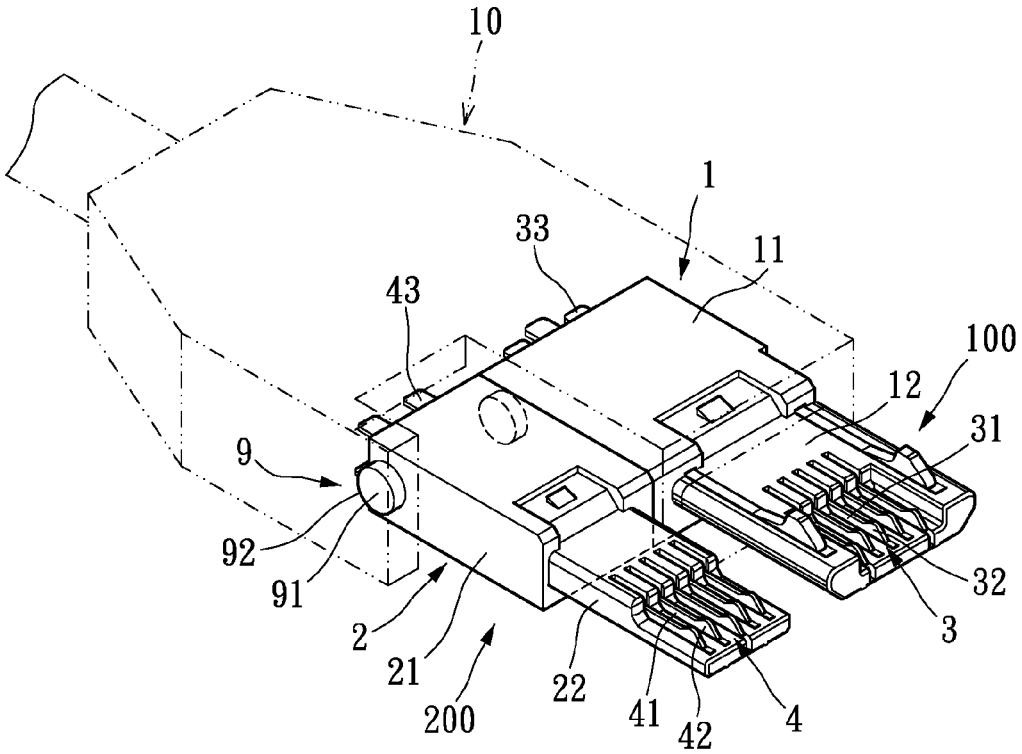
FIG. 10 is a schematic diagram of a rotatable USB connector with a shaft assembly in accordance with a third embodiment of the instant disclosure.
Figure 11:
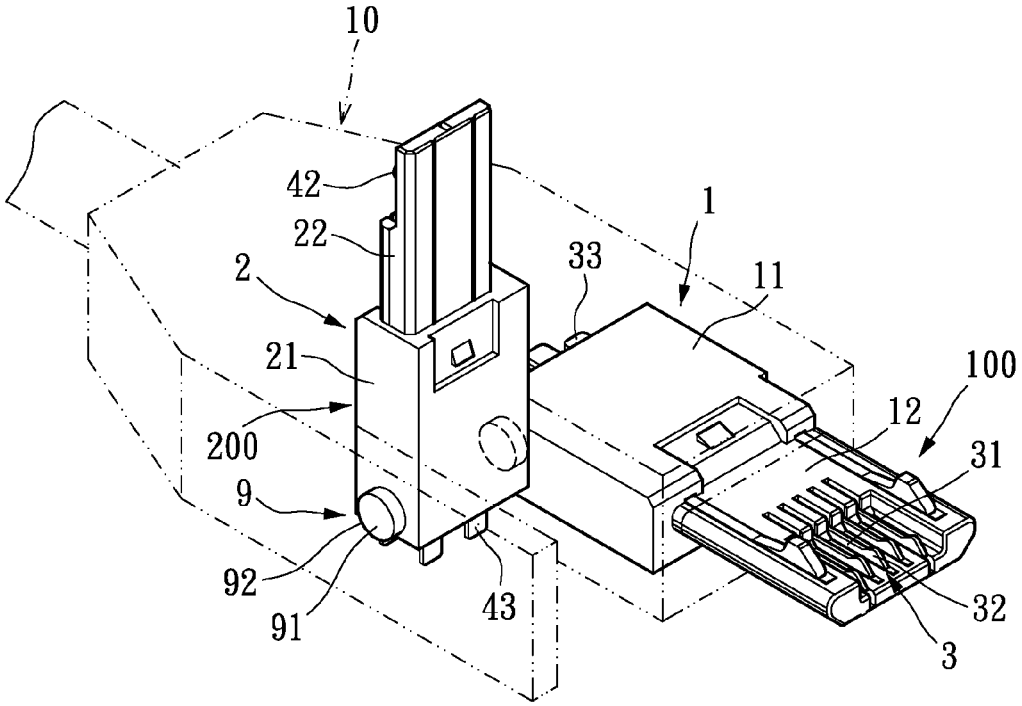
FIG. 11 is a schematic diagram of a rotatable USB connector with a shaft assembly swiveling aside in accordance with a third embodiment of the instant disclosure.

Please refer to FIG. 10 in conjunction with FIG. 11. In a third embodiment, the first and second connector modules 200, 300 are pivotally connected to allow upward and downward movement. A shaft assembly 9 is disposed at the read end of the second connector module 200. The shaft assembly 9 includes a shaft 91 and a shaft sleeve 92 and the structure of the shaft assembly 9 is not limited thereto. The shaft 91 laterally passes through the second connector module 200. The shaft 91 is disposed in between either the first and second connector modules 100, 200 or the second connector module 200 and the jacket 10. The arrangement of the shaft 91 and the shaft sleeve 92 is interchangeable between the second connector module 200 and the jacket 10.

In the third embodiment, only the second connector module 200 is able to turn upward or downward (as shown in FIG. 11) so the first connector module 100 can be singled out on the jacket 10 and connect a corresponding receptacle independently. The first and second connector modules can also be combined together to act as a USB 3.0 connector (as shown in FIG. 10).

In the third embodiment, the first and second connector modules 100, 200 are connected by the shaft assembly 9. The shaft assembly 9 can be disposed between the first and second insulation main bodies 1, 2 or among the first, second insulation main bodies 1, 2 and the jacket 10.

In order to allow smooth rotation of the first and second connector modules 100, 200, connection cables can be longer in length than the conventional standard or passing through the interior of shaft assembly 7, 9.

[Fourth, Fifth and Sixth Embodiment]

Figure 12:
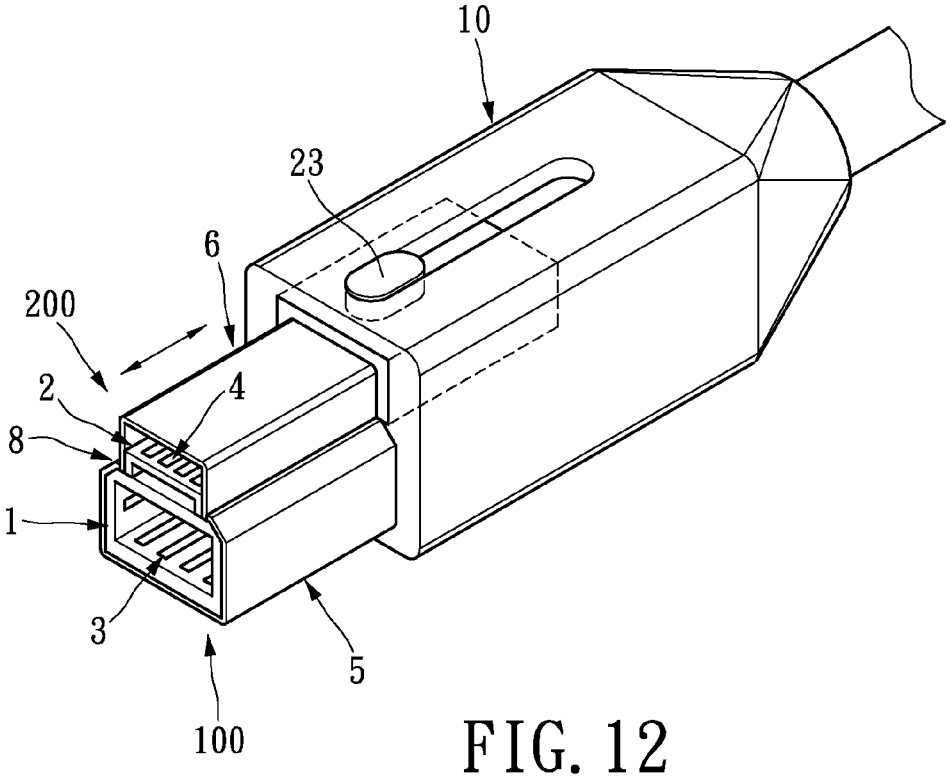
FIG. 12 is a schematic diagram of a rotatable USB connector in accordance with a fourth embodiment of the instant disclosure.
Figure 13:
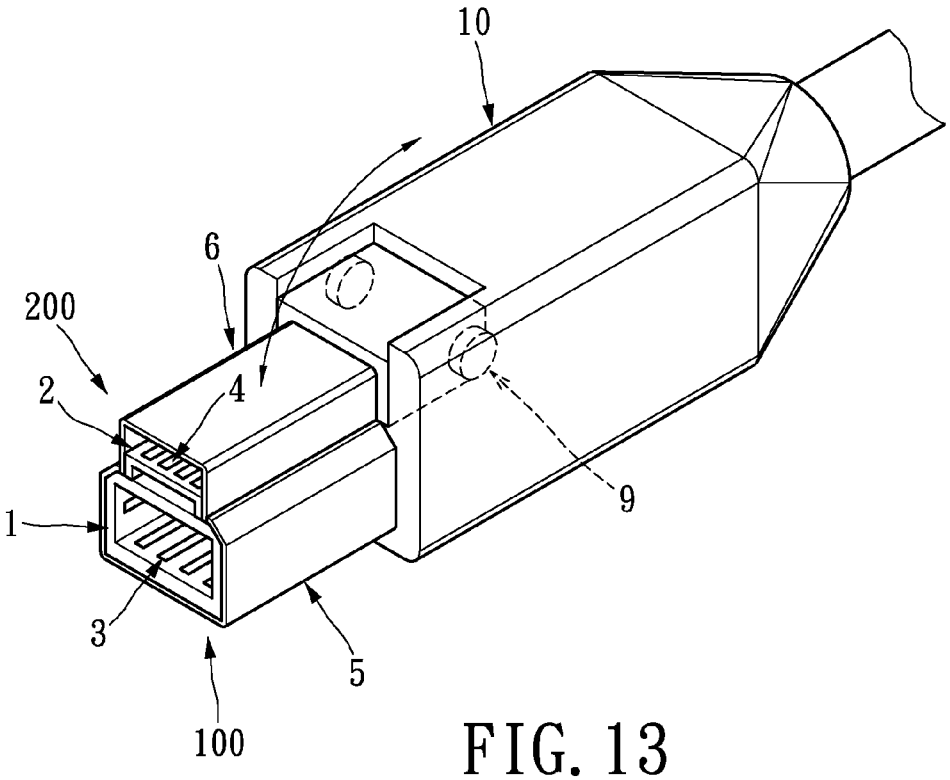
FIG. 13 is a schematic diagram of a rotatable USB connector in accordance with a fifth embodiment of the instant disclosure.
Figure 14:
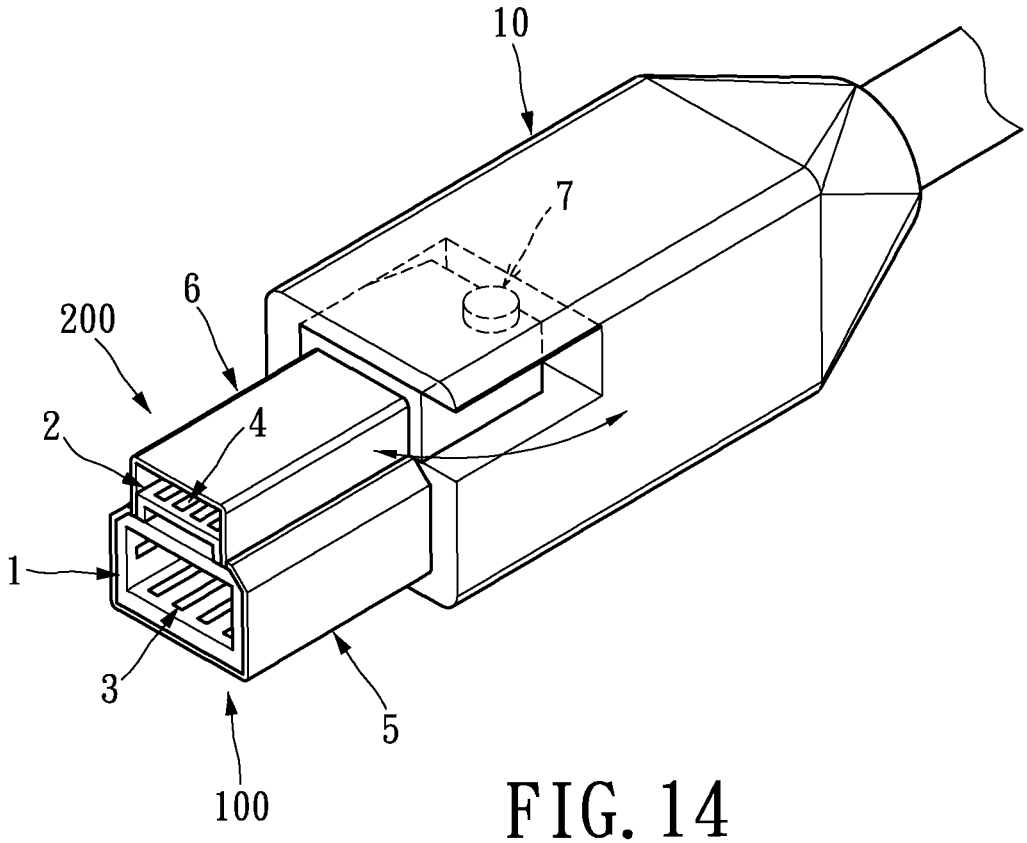
FIG. 14 is a schematic diagram of a rotatable USB connector in accordance with a sixth embodiment of the instant disclosure.

Please refer to FIG. 12 to FIG. 14. In the fourth, fifth and sixth embodiments, the rotatable USB connectors are compatible with USB 3.0 Standard-B connectors. The rotatable USB connectors of the fourth, fifth and sixth embodiments are substantially in accordance with the first, second and third embodiments yet differ in the USB 3.0 connector architecture. The first and second connector modules 200, 300 are independent modules stacked together thus being able to be separated if needed. The first and second connector modules 200, 300 can be connected by pivot pins, tenon or through sliding groove and can further combine with the jacket 10 as one unit. The first and second connector modules 100, 200 have a variety of movements including swiveling, sliding and swaying.

In addition, the connection is not limited between the first and second insulation main bodies 1, 2. As long as the first and second connector modules 100, 200 are mobile, the joint can also be disposed between or among any of the following: the first and second shells 5, 6, the first, second insulation main bodies 1, 2 and jacket 10, and the first and second connector modules 100, 200. The first and second connector modules 100, 200 can be enveloped by individual jackets and connected indirectly via the two jackets (not shown).

[Seventh and Eighth Embodiment]

Figure 15:
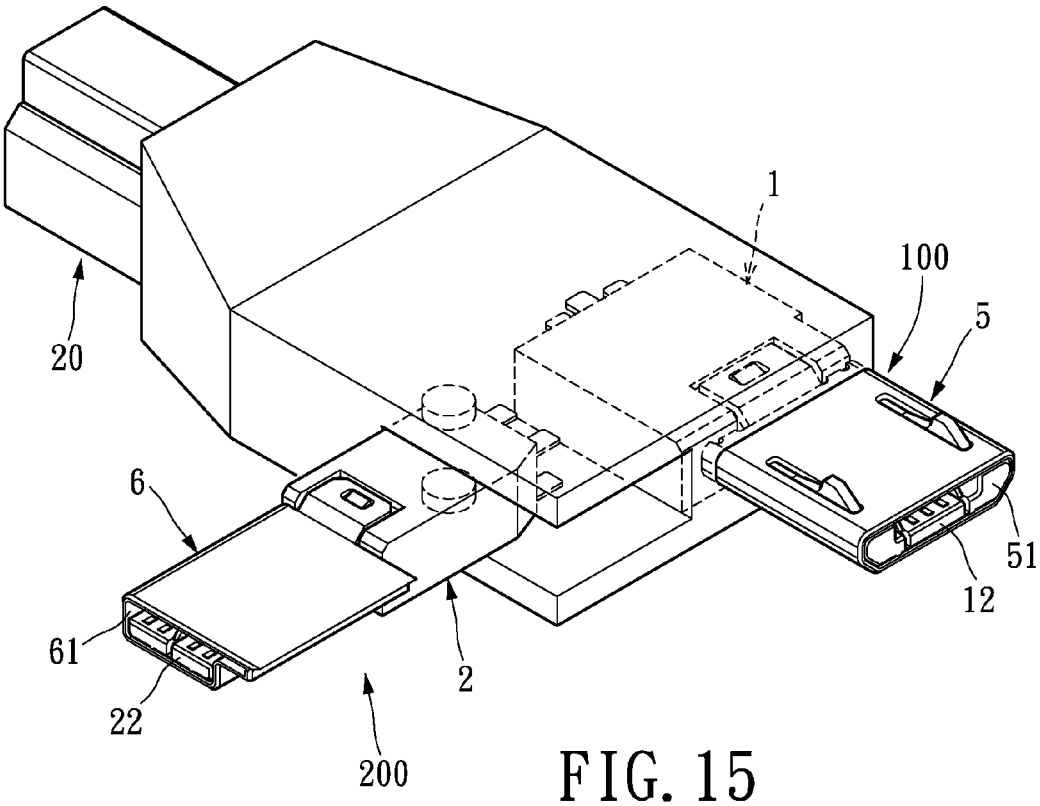
FIG. 15 is a schematic diagram of a rotatable USB connector in accordance with a seventh embodiment of the instant disclosure.
Figure 16:
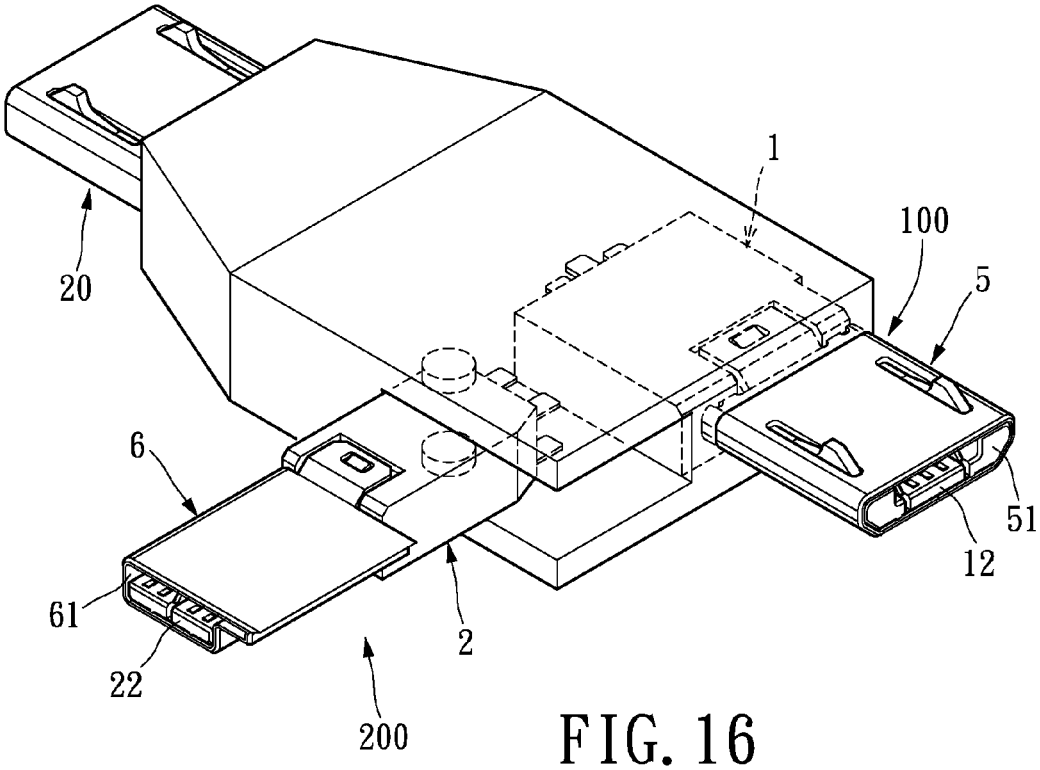
FIG. 16 is a schematic diagram of a rotatable USB connector in accordance with an eighth embodiment of the instant disclosure.

Please refer to FIG. 15 in conjunction with FIG. 16. In the seventh and eighth embodiments, the rotatable USB connectors are conform to the USB 3.0 Micro-B connector specification. The rotatable USB connectors are connected to the first USB plug 20 at the rear end and the first and second mounting terminals 33, 43 electronically connect the terminal of the first USB plug 20 to form a convertor (not shown). The first USB plug 20 is compatible with USB 3.0 communication protocol.

[Ninth and Tenth Embodiment]

Figure 17:
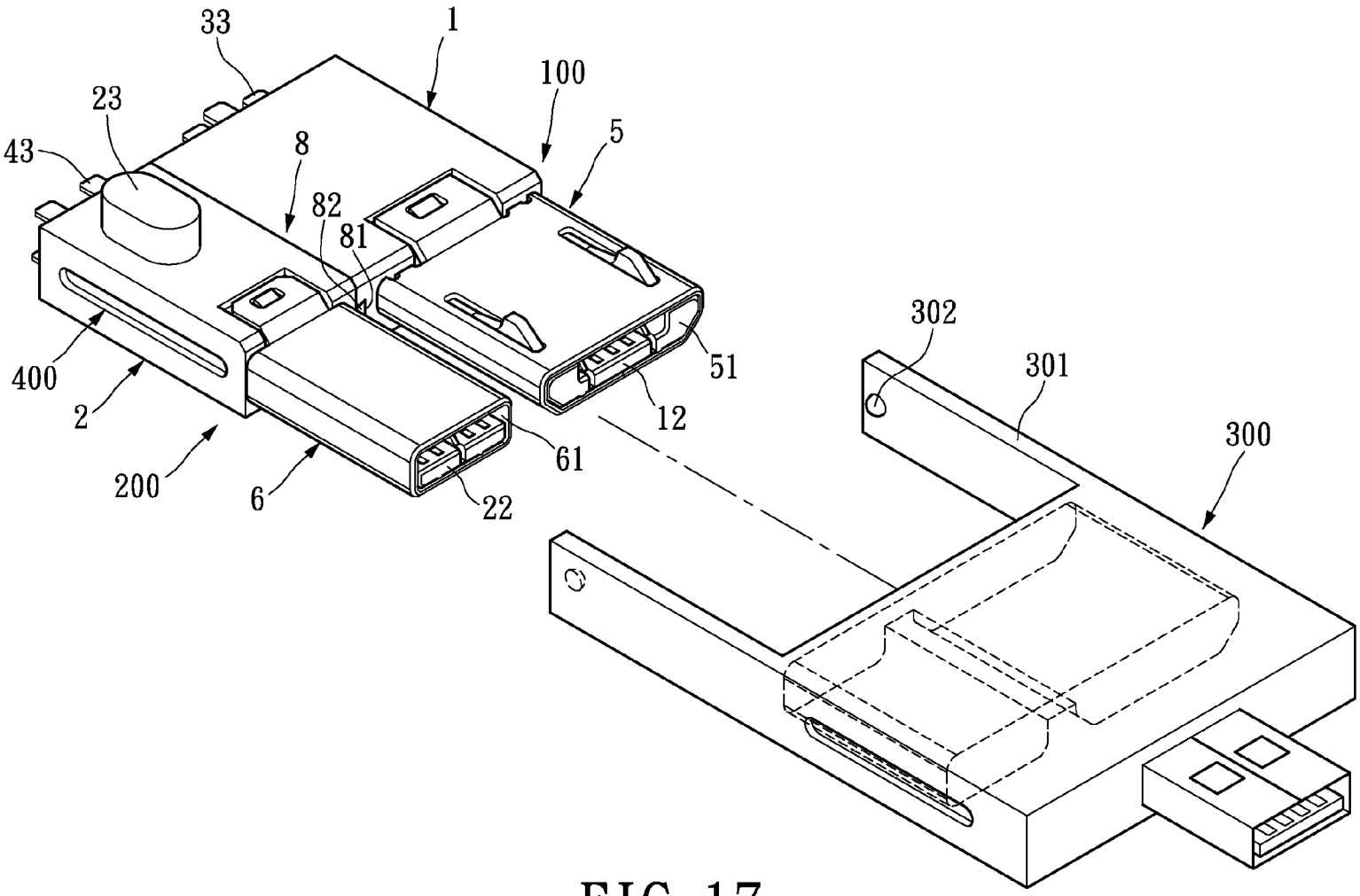
FIG. 17 is a schematic diagram of a rotatable USB connector with a convertor in accordance with a ninth embodiment of the instant disclosure.
Figure 18:
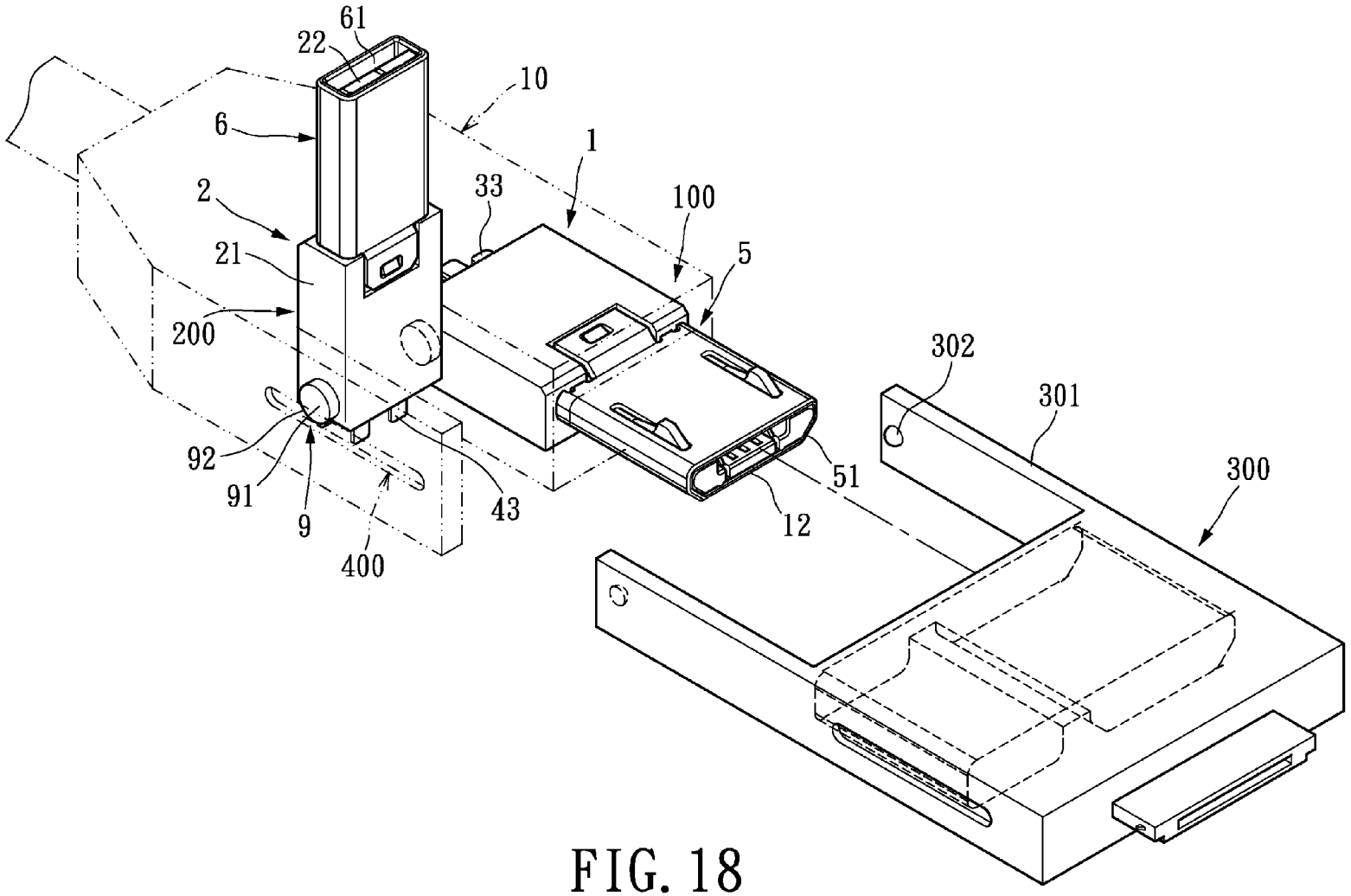
FIG. 18 is a schematic diagram of a rotatable USB connector with a shaft assembly and a convertor in accordance with a tenth embodiment of the instant disclosure.

Please refer to FIG. 17 in conjunction with FIG. 18. In the ninth and tenth embodiment, a pair of tracks 400 is formed at opposite side of the rotatable USB connector for a convertor 300 sliding through. Also, the rotatable USB connector is electrically connected to the convertor 300. The convertor 300 includes two arms 301 with two knobs 302 which conform to the tracks 400 and are disposed on each of the arms 301 respectively so the convertor 300 can slide forward and backward along the tracks 400. In addition, the convertor 300 allows free movement of the rotatable USB connector without demounting the convertor 300 completely.

[Eleventh Embodiment]

Figure 19:
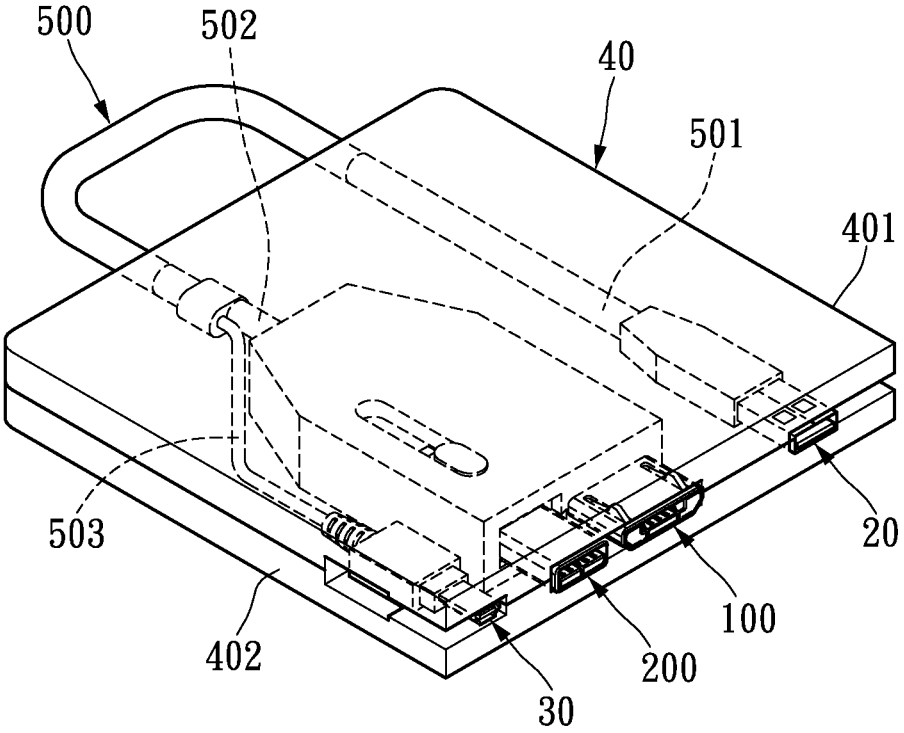
FIG. 19 is a schematic diagram of a USB device using a rotatable USB connector in accordance with an eleventh embodiment of the instant disclosure.

Please refer to FIG. 19. The first, second USB plugs 20, 30, rotatable USB connector and cable 500 are disposed in the case 40. However, the cable 500 may stretch out of the case 40 to act as a hanger.

[Twelfth Embodiment]

Figure 20:
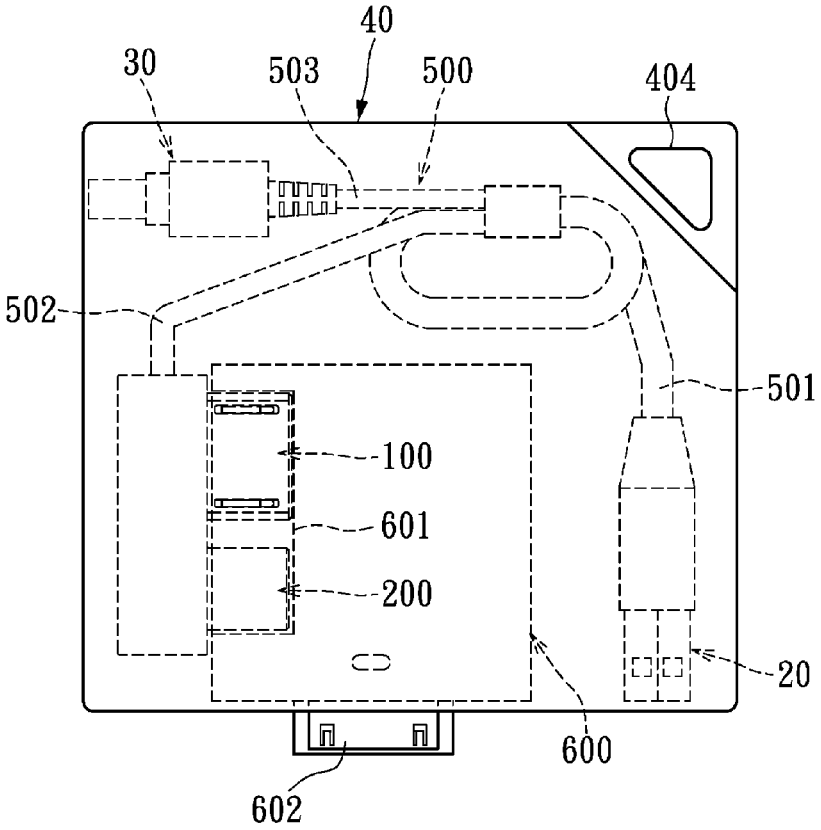
FIG. 20 is a schematic diagram of a USB device using a rotatable USB connector in accordance with a twelfth embodiment of the instant disclosure.

Please refer to FIG. 20. A conversion connector 600 is disposed in the case 40. The conversion connector 600 includes an electrically connected female connector 601 and a male connector 602. The male connector 602 projects out of the case 40 to connect other types of connectors while the female connector 601 conformingly connects to the first and second connector modules 100, 200.

[Thirteenth and Fourteenth Embodiment]

Figure 21:
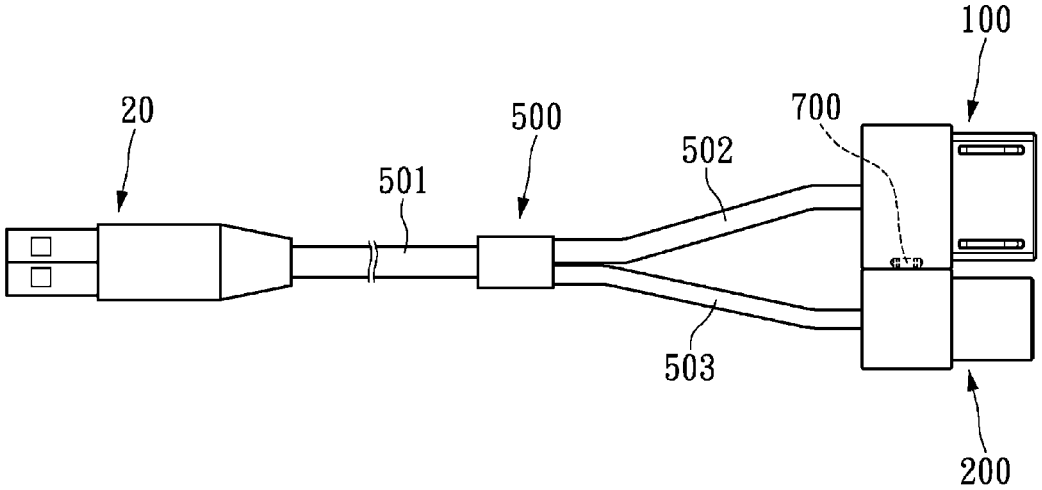
FIG. 21 is a schematic diagram of a rotatable USB connector with a joint in accordance with a thirteenth embodiment of the instant disclosure.
Figure 22:
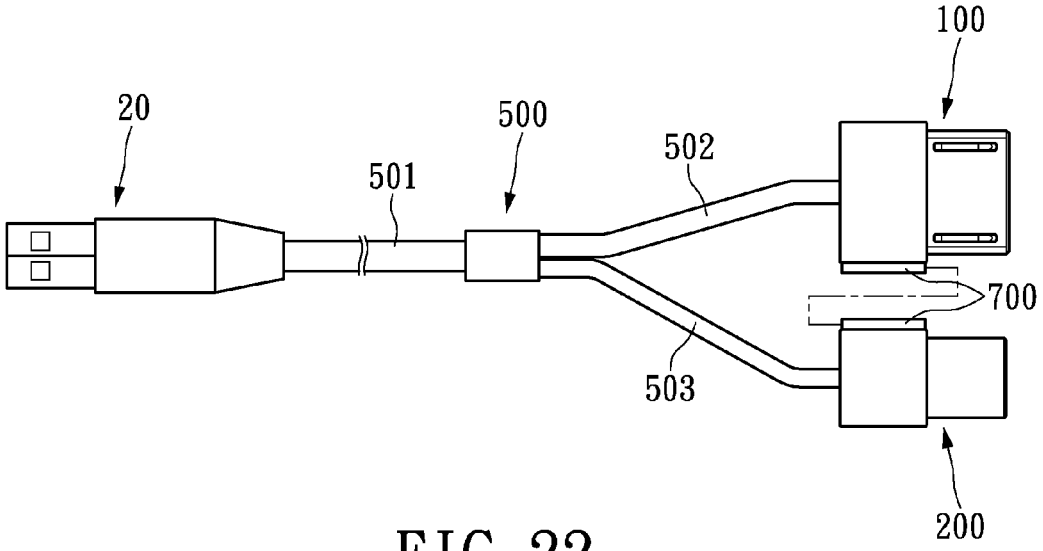
FIG. 22 is a schematic diagram of a rotatable USB connector with a joint in accordance with a fourteenth embodiment of the instant disclosure.

Please refer to FIG. 21 and FIG. 22. The USB connector may electrically connect the Y-shaped cable 500. The tail end 501 connects a first USB plug 20, the first branch end 502 connects the first connector module 100 and the second branch end 503 connects the second connector module 200. The USB connector electrically connects the first USB plug 20 via the cable 500. As shown in FIG. 21, the first and second connector modules 100, 200 are interconnected by a joint 700, so that the first and second connector modules 100, 200 can cooperatively conform to the USB 3.0 Micro-B connector specification. As shown in FIG. 22, the first and second connector modules 100, 200 are detached from one another, so that the first connector module 100 can be used independently if needed. In FIG. 21, the joint 700 is a tenon while in FIG. 22 the joint 700 is a slider.

[Fifteenth Embodiment]

Figure 23:
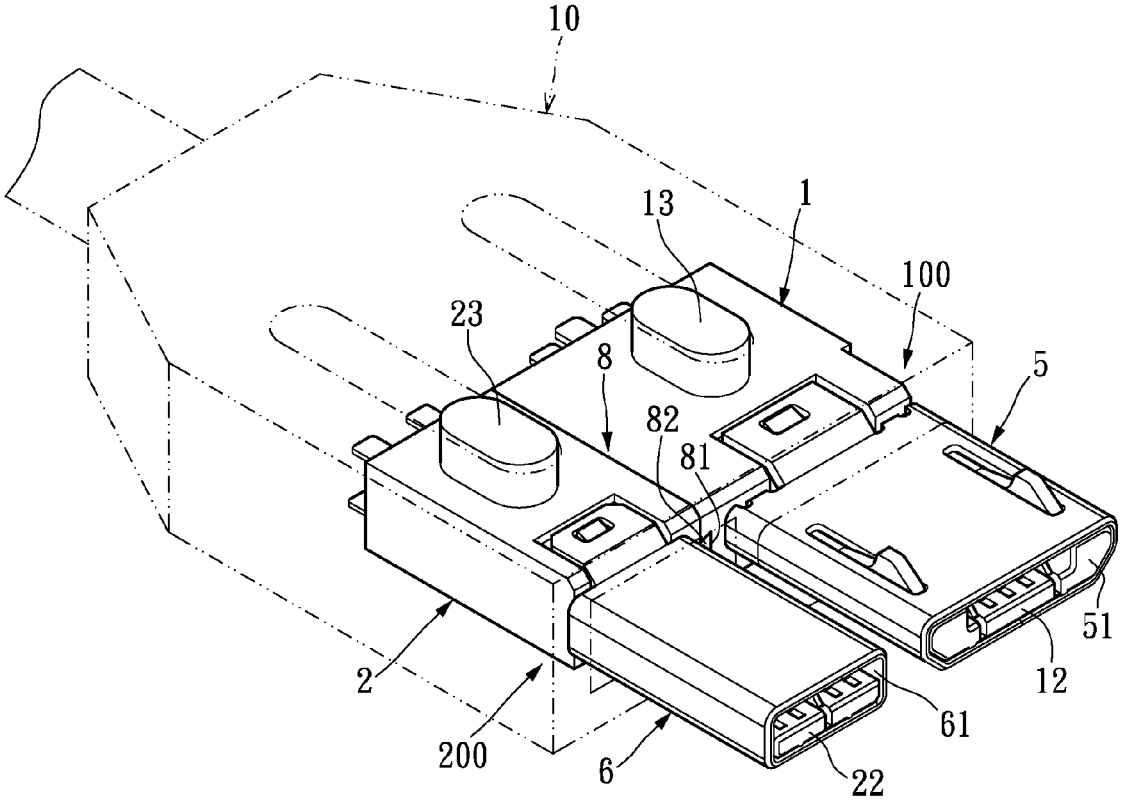
FIG. 23 is a schematic diagram of a rotatable USB connector with slide buttons in accordance with a fifteenth embodiment of the instant disclosure.

Please refer to FIG. 23. The first and second connector modules 100, 200 are movably disposed in the jacket 10. Each of the first and second insulation main bodies 1, 2 includes a slide button 13, 23 respectively to facilitate easier sliding of the first and second connector modules 100, 200.

In the instant disclosure, the first and second connector modules 100, 200 are mobile and separable to allow various angles and connector combinations for different usages. Also, the jacket 10 may further envelop the first and second connector modules 100, 200 without compromising the mobility thereof. The first, second USB plugs 20, 30, the rotatable USB connector and the cable 500 are disposed in the case 40 for better organization and transportation.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A Y-shaped Universal Serial Bus (USB) connector for USB 2.0 Micro-B and USB 3.0 Micro-B connector specifications, comprising:

a cable with a tail end, a first branch end and a second branch end;

a first insulating main body;

a second insulating main body;

a plurality of first conductive terminals disposed in the first insulating main body; and a plurality of second conductive terminals disposed in the second insulating main body, wherein the first insulating main body and the plurality of first conductive terminals form a first connector module, the second insulating main body and the plurality of second conductive terminals form a second connector module, wherein the tail end connects a first USB plug, the first branch end connects the first connector module and the second branch end connects the second connector module, and the first and second connector modules are configured to be detachably interconnected by a joint;

wherein when the first and second connector modules are detached from one another, the first connector module separately conforms to the USB 2.0 Micro-B connector specification;

wherein when the first and second connector modules are interconnected with one another in a side-by-side arrangement, the first and second connector modules cooperatively conform to the USB 3.0 Micro-B connector specification.

2. The Y-shaped USB connector according to claim 1, wherein the first insulating main body includes a first housing and a first tongue pointing outward from the first housing, the second insulating main body includes a second housing, a second tongue pointing outward from the second housing, the plurality of first conductive terminals are disposed in the first tongue passing through the first housing, and the plurality of second conductive terminals are disposed in the second tongue passing through the second housing.

3. The Y-shaped USB connector according to claim 1, wherein the joint includes a sliding unit, wherein the sliding unit is disposed levelly between the first and second connector modules.

* * * * *